US006132340A

United States Patent [19]

Wang et al.

[11] Patent Number: 6,132,340

[45] Date of Patent: Oct. 17, 2000

[54] CUSHIONING DEVICE FOR TREADMILL

[76] Inventors: Leao Wang; Peter Wu, both of No 1, Lane 154, Charng Long Rd., Taiping City, Taichung Hsien, Taiwan

[21] Appl. No.: 09/337,528

[22] Filed: Jun. 22, 1999

[51] Int. Cl.[7] ..... A63B 22/00

[52] U.S. Cl. ..... 482/54; 482/51

[58] Field of Search ..... 482/51, 54

[56] References Cited

U.S. PATENT DOCUMENTS 5,976,061 11/1999 Moon et al. ..... 482/54

5,993,358 11/1999 Gureghian et al. ..... 482/54

*Primary Examiner*—Glenn E. Richman

*Attorney, Agent, or Firm*—Dougherty & Troxell

[57] ABSTRACT

The present invention is related to a cushioning device for treadmill having a frame with a running belt, a hand support, a base and a front supporting shaft. An electric control panel is mounted at the center on the hand support while the front supporting shaft is pivoted near the front end of the base by two sloping side frames. A height adjusting mechanism is used to adjust the sloping angle of the frame, and the rear end of the frame is pivoted to pivot pieces on the base. At least one resilient elastomer for cushioning is respectively mounted between the base and the frame.

2 Claims, 4 Drawing Sheets

CUSHIONING DEVICE FOR TREADMILL

BACKGROUND OF THE INVENTION

1. Field of the Invention

The present invention relates to a cushioning device for treadmill, and more particularly to a device with compact components, easy assembly and better cushioning and shockproof effect.

2. Description of the Prior Art

First of all, the conventional treadmill 10, as shown in FIG. 5, is a sporting device with a running cycle belt 11 which makes a cyclical rotation around a frame by means of a motor (not shown) and related transmission components so that the user can run on the running cycle belt 11 during running exercise. However, the frame 12 has to support all of the forces created in the process of the user's motion. Thus, the quality of the cushioning mechanism 13 is a critical element for the user to have a stable and comfortable feeling in using the treadmill 10.

It's popular in the conventional products (such as U.S. Pat. Nos. 5,441,468; 5,279,528; 5,454,772) that the cushioning mechanism 13 is mounted under the running plate 14 located inside of the running cycle belt 11 and between the running plate 14 and the frame 12. Consequently, when the running plate 14 is forced, a cushioning effect with lower machine vibration can be achieved. However, the frame 12 and the other components of the machine 10 (like hand support 15, the front and rear supporting rods 16, 17) are secured together and the clearance between the running plate 14 and the frame 12 is too small so that the frame 12 after being forced will also produce a little vibration. The vibration of the frame 12 also means the vibration of the whole machine 10.

SUMMARY OF THE INVENTION

It is the main object of the present invention to provide a cushioning device for a treadmill in which the frame and the machine body are pivoted to each other in order to lower the coupled relationship between the frame and the machine body. The reaction force will be directly transmitted to the base by means of cushioning resilient elastomers so that the ground absorbs all of the reaction force, and the cushioning and shockproof effect can be completely achieved.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
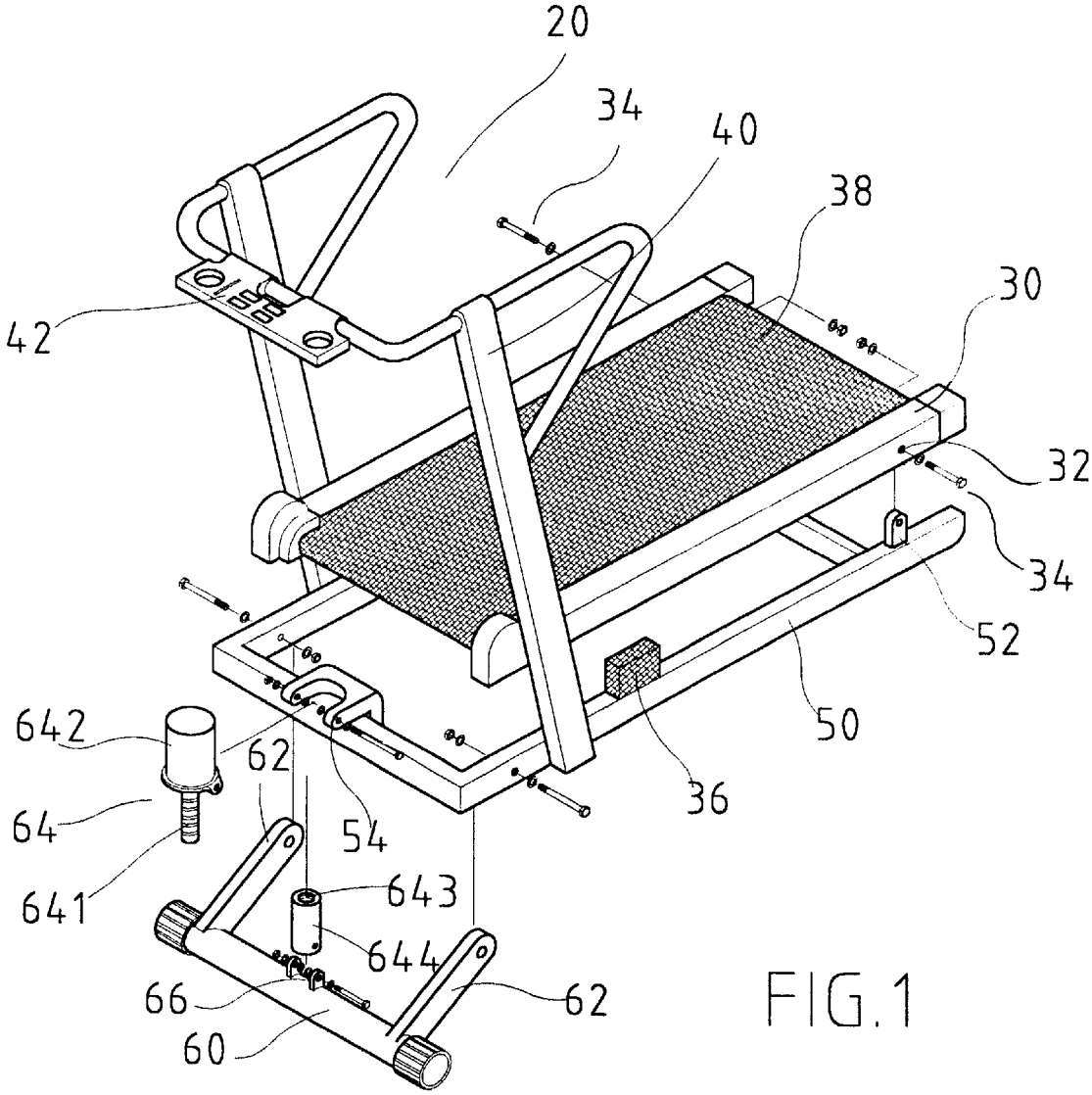
FIG. 1 is an exploded perspective view of the present invention.
Figure 2:
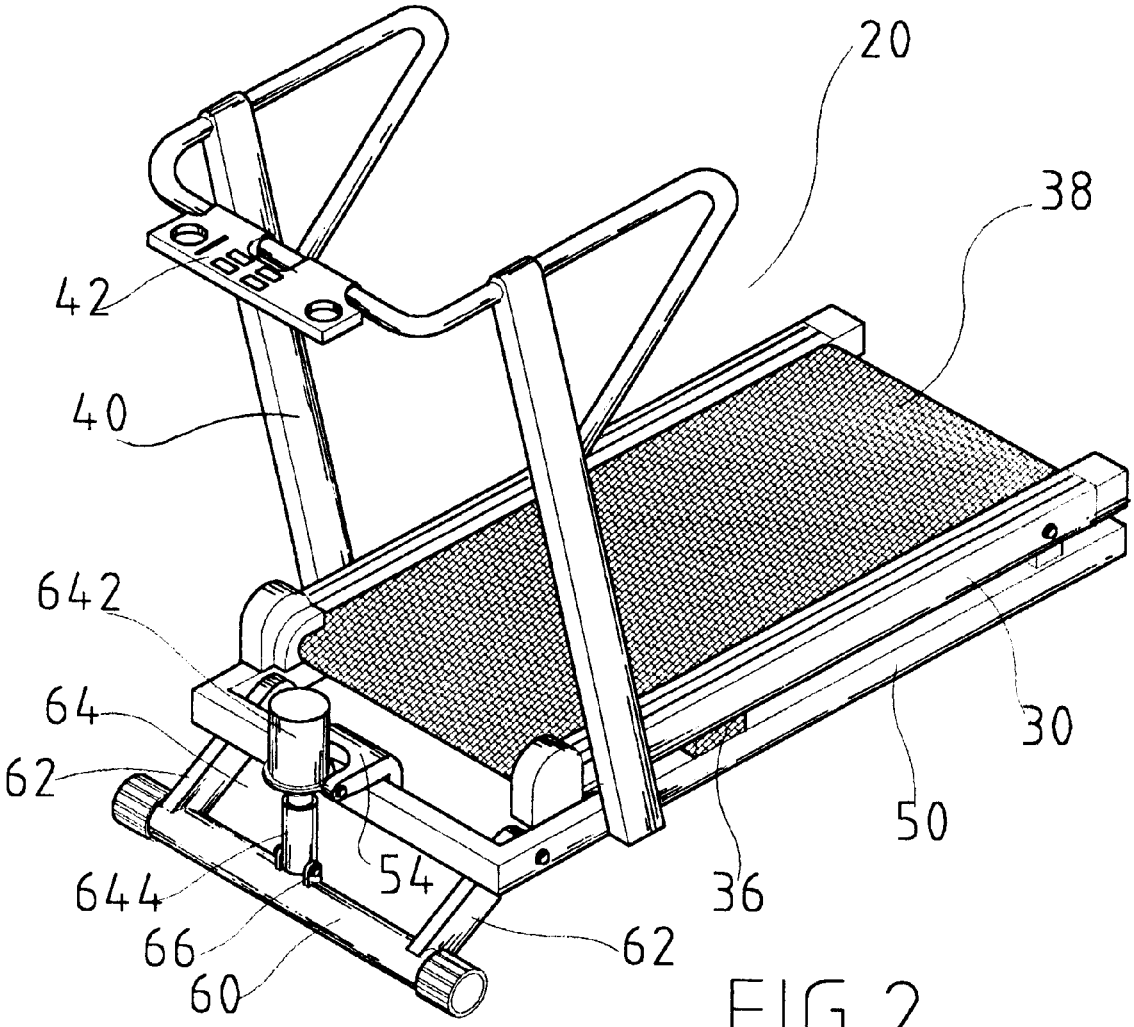
FIG. 2 is a perspective view of the present invention after assembly.

First of all, referring to FIGS. 1 and 2, the treadmill 20 in accordance with the present invention includes a frame 30 with a running belt 38, a hand support 40, a base 50 and a front supporting shaft 60. An electric control panel 42 is mounted at the center on the hand support 40 while the front supporting shaft 60 is pivoted near the front end of the base 50 by means of two sloping side frames 62, wherein a height adjusting mechanism 64 is used to adjust the sloping angle of the frame 30. The through holes 32 on two sides near the rear end of the frame 30 are pivoted to pivot pieces 52, and at least one resilient elastomer 36 for cushioning is respectively mounted at a certain position on the surface of two sides of the base 50 and is always located between the base 50 and the frame 30 so as to achieve an expected cushioning effect.

Figure 3:
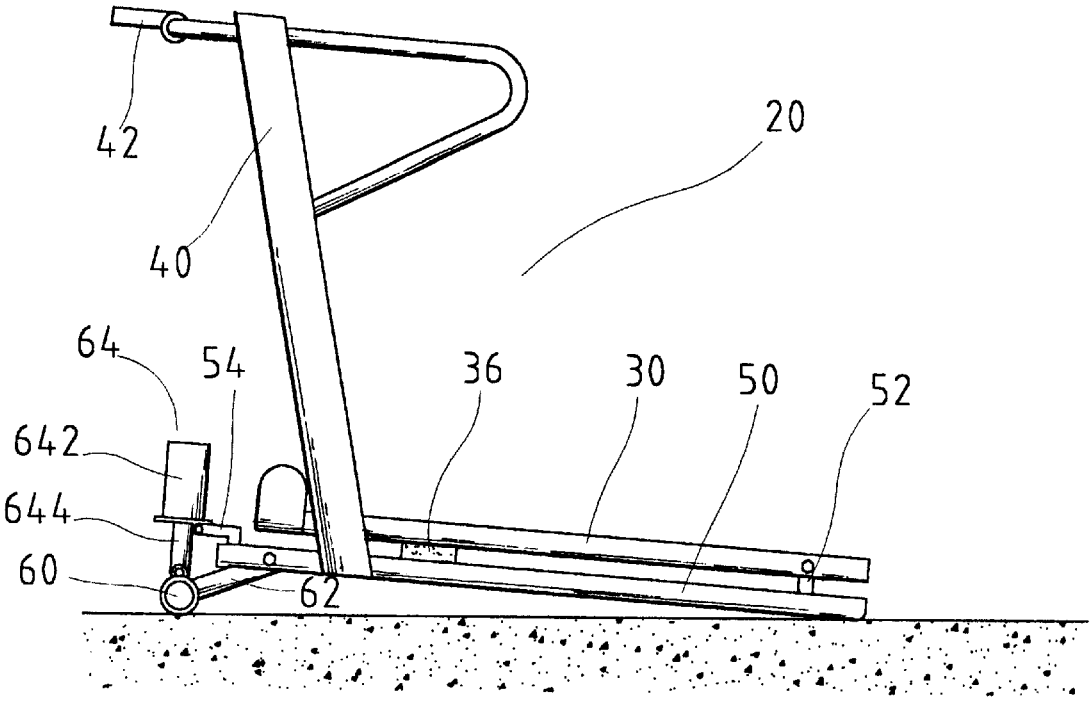
FIG. 3 is a side view of the present invention after assembly.
Figure 4:
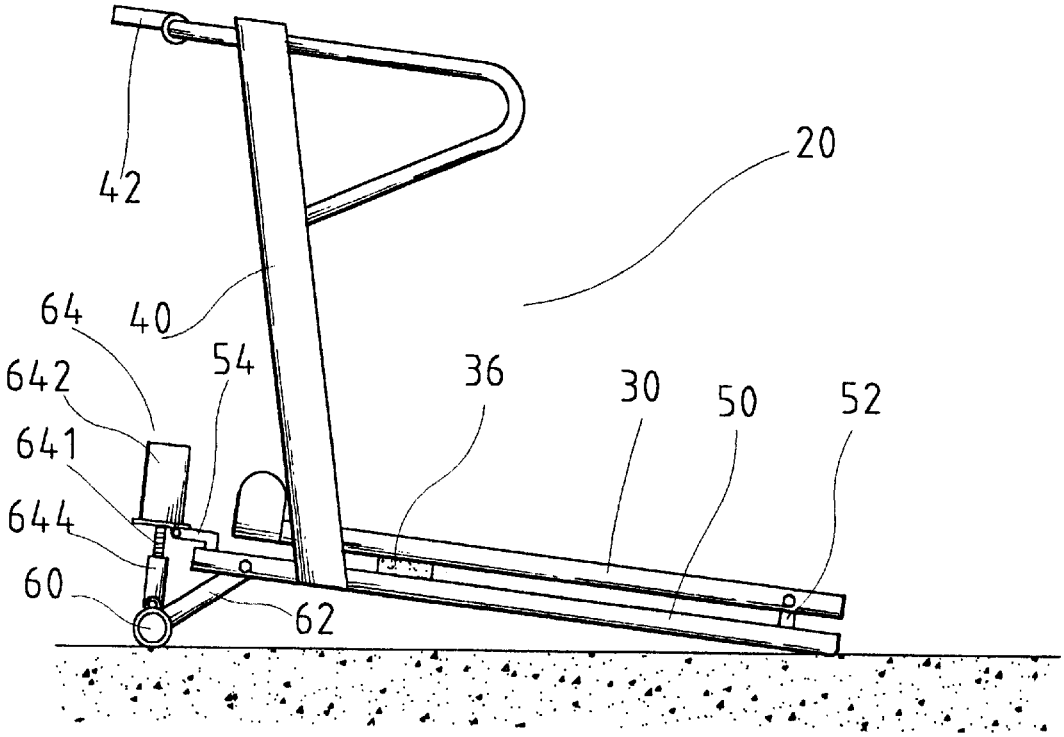
FIG. 4 is a structural side application view of the present invention.
Figure 5:
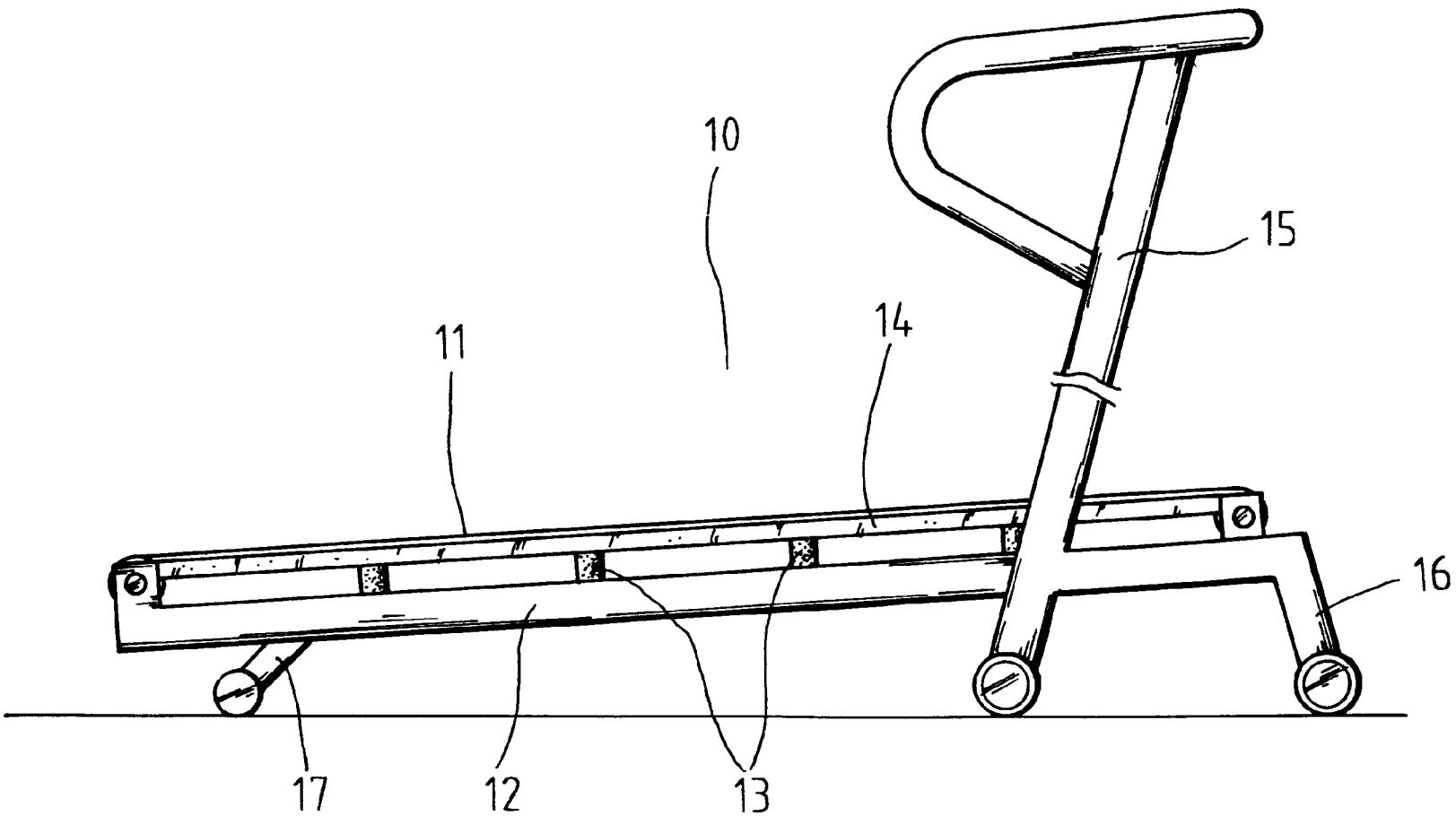
FIG.5 PRIOR ART
FIG. 5 is a side view of a conventional cushioning device for a treadmill.

The height adjusting mechanism 64 is fitted to an ear-shaped holding piece 54 at the center of the front end of the base 50 and includes a driving member 642 with outer threaded bolt 641 which is screwed into a sleeve 644 with inner an threaded hole 643. The other end of the sleeve 644 is pivoted to a connecting ear 66 on the surface of the front supporting shaft 60 so as to adjust the supporting angle of the front supporting shaft 60. Accordingly, as shown in FIGS. 3 and 4, the screwed depth between the outer threaded bolt 641 and the sleeve 644 will decide the sloping angle of the frame 30 and the base 50. However, no matter what the sloping angle of the frame 30 is, the resilient elastomer 36 is always located between the frame 30 and the base 50 in order to provide the expected effect.

The operation of the running belt 38 and the height adjusting mechanism 64 belongs to the prior art, rather than features of the present invention so that it won't be described hereafter.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A cushioned treadmill comprising:

a) a base having a front base portion and a rear base portion;

b) a hand support extending upwardly from the base;

c) a frame having an endless running belt thereon, the frame having a rear frame portion pivotally connected to the rear base portion, and a front frame portion;

d) at least one resilient cushioning member located between and in contact with the base and the frame, the at least one resilient cushioning member located adjacent to the front frame portion such that the front frame portion is out of contact with the front base portion;

e) a front support pivotally connected to the front base portion to support the front base portion on a surface; and, f) a height adjusting mechanism connected to the front support and to the front base portion to adjust a height of the front base portion above the surface.

2. The cushioned treadmill of claim 1 wherein the height adjusting mechanism comprises:

a) an internally threaded sleeve pivotally connected to the front support; and, b) a driving member attached to the front base portion and having a threaded bolt engaging the threaded sleeve.

* * * * *